US010166464B2

(12) United States Patent
Todokoro

(10) Patent No.: US 10,166,464 B2
(45) Date of Patent: Jan. 1, 2019

(54) PUZZLE

(71) Applicant: AGATSUMA CO., LTD., Tokyo (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 0 days.

(21) Appl. No.: 15/790,025

(22) Filed: Oct. 22, 2017

(65) Prior Publication Data

US 2018/0272230 A1 Sep. 27, 2018

(30) Foreign Application Priority Data

Mar. 21, 2017 (JP) ..... 2017-054950

(51) Int. Cl.
*A63F 9/08* (2006.01)
*A63F 9/06* (2006.01)

(52) U.S. Cl.
CPC ..... *A63F 9/0865* (2013.01); *A63F 9/0602* (2013.01)

(58) Field of Classification Search
CPC .... A63F 9/0865; A63F 9/0602; A63F 9/0826; A63F 9/12
USPC ..... 273/157 R, 153 S
See application file for complete search history.

(56) References Cited

U.S. PATENT DOCUMENTS 1,636,371 A * 7/1927 Kenney ..... A63F 9/0819 273/155
1,784,364 A * 12/1930 Von Der Lippe-Lipski ..... G09F 11/025 273/155
2,581,492 A * 1/1952 Lowe ..... A63F 3/04 273/157 R
3,010,227 A 11/1961 Glass
3,302,311 A * 2/1967 Israel ..... A63F 9/12 273/155
3,410,011 A * 11/1968 Bowman ..... A63F 3/00261 273/271
3,462,857 A * 8/1969 Barlow ..... A63F 3/00261 273/281
3,706,148 A * 12/1972 Johnston ..... G09F 9/37 40/447

(Continued)

FOREIGN PATENT DOCUMENTS

GB 2 360 112 A 9/2001
JP 06-190413 H 12/1994

OTHER PUBLICATIONS

Extended European Search Report from the Munich Patent Office in related Application No. 17197658.2-1126 dated Apr. 13, 2018.

*Primary Examiner* — Steven Wong
(74) *Attorney, Agent, or Firm* — The Marbury Law Group, PLLC

(57) ABSTRACT

In order to provide a puzzle that allows young children to enjoy puzzle games easily and pleasantly, a puzzle 1 has a housing main body 10 and a puzzle shaft 40 provided in the housing main body 10. The puzzle shaft 40 includes a shaft and a piece 30. The shaft is provided with rotation of the shaft centers fixed. A plurality of pieces that is rotatably provided around the shaft center of the shaft along a shaft center direction of the shaft via the shaft and a ratchet mechanism, and puzzle patterns are provided to outer periphery of the shaft around the shaft center. The ratchet mechanism is made up of ratchet teeth formed on the outer periphery of the shaft and a ratchet pawl provided to the piece via an elastic portion.

1 Claim, 8 Drawing Sheets

(56) References Cited

U.S. PATENT DOCUMENTS

| | | | | | |
|---|---|---|---|---|---|
| 4,021,939 | A * | 5/1977 | May | A63H 33/04 | 273/157 R |
| 4,735,417 | A * | 4/1988 | Gould | A63F 9/0819 | 273/153 S |
| 4,783,081 | A * | 11/1988 | Eckhardt | A63F 3/00261 | 273/281 |
| 4,949,969 | A * | 8/1990 | Johnson | A63F 9/001 | 273/153 R |
| 5,074,561 | A * | 12/1991 | Johnson | A63F 9/001 | 273/153 S |
| 5,562,459 | A * | 10/1996 | Durlach | G09F 11/025 | 345/110 |
| 7,785,179 | B2 * | 8/2010 | Ionescu | A63F 3/0421 | 463/9 |
| 7,861,926 | B2 * | 1/2011 | Sheldon | G06Q 20/3415 | 235/380 |
| 8,251,366 | B1 | 8/2012 | Nathan et al. | | |
| 2003/0227131 | A1 * | 12/2003 | Han | A63F 9/083 | 273/153 S |
| 2005/0206080 | A1 * | 9/2005 | Chuang | A63F 9/12 | 273/157 R |
| 2006/0061033 | A1 * | 3/2006 | Han | A63F 9/083 | 273/153 S |
| 2014/0239588 | A1 * | 8/2014 | Fry | A63F 3/00094 | 273/153 S |

* cited by examiner

PUZZLE

CROSS-REFERENCE TO RELATED APPLICATION

This application is based upon and claims the benefit of priority under 35 USC 119 of Japanese Patent Application No. 2017-054950 filed on Mar. 21, 2017, the entire disclosure of which, including the description, claims, drawings, and abstract, is incorporated herein by reference in its entirety.

BACKGROUND OF THE INVENTION

Field of the Invention

The present invention relates to a puzzle that has a plurality of pieces having puzzle patterns and being rotatably provided to a shaft.

Description of the Related Art

There have been disclosed puzzles that offer a matching puzzle game in which a plurality of pieces having puzzle patterns is provided rotatably to a shaft so as to be rotated. In a puzzle disclosed in TOKUKAI (Japanese Unexamined Patent Application Publication) No. Hei 6-190143, three bases having three hexahedral pieces are slidably disposed in the lateral direction. Moving the base in the lateral direction allows the pieces to be rotatable for doing the matching puzzle game.

TOKUKAI (Japanese Unexamined Patent Application Publication) No. Hei 6-190143 discloses a puzzle toy whose pieces can be rotated continuously when the base is moved in the lateral direction. Therefore, in a matching puzzle game for producing an image, sometimes positioning the pieces in the rotational direction properly may be difficult in particular for young children, so fun of the matching puzzle game sometimes becomes less interesting to the young children.

SUMMARY OF THE INVENTION

An object of the present invention is to provide a puzzle with which even young children can enjoy a matching puzzle game with ease.

A puzzle of the present invention includes a housing main body and a puzzle shaft provided to the housing main body, where the puzzle shaft is provided with a shaft whose rotation of a shaft center is fixed, and a plurality of pieces that is rotatably provided around the shaft center of the shaft along a shaft center direction of the shaft via the shaft and a ratchet mechanism, and puzzle patterns are provided to outer periphery of the shaft around the shaft center.

With the present invention, even young children can have fun with the matching puzzle game since position of the pieces can be matched with ease.

DETAILED DESCRIPTION OF THE PREFERRED EMBODIMENT

Figure 1:
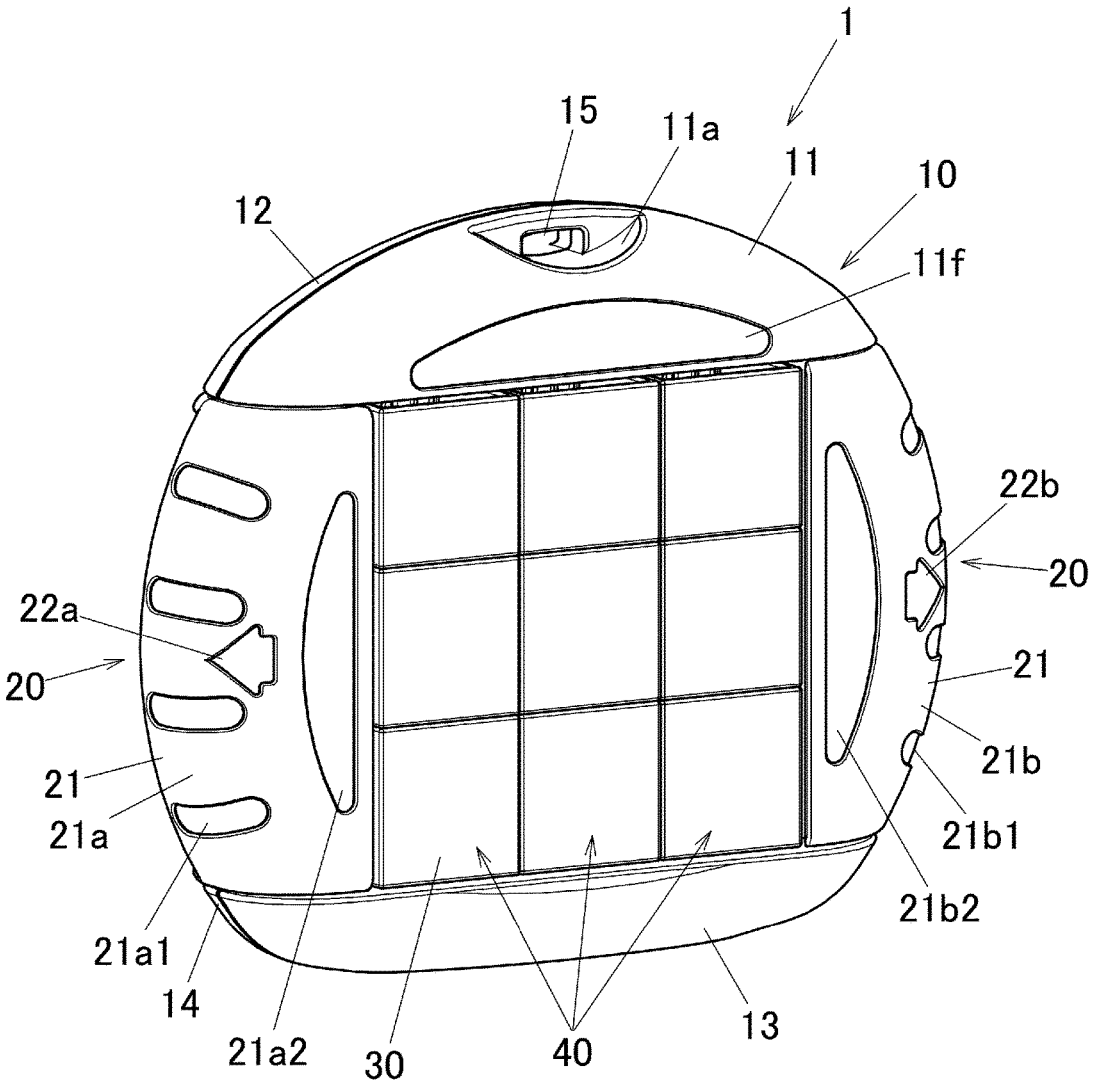
FIG. 1 is a perspective view of a puzzle according to an embodiment of the present invention, showing a front side of the puzzle.
Figure 2:
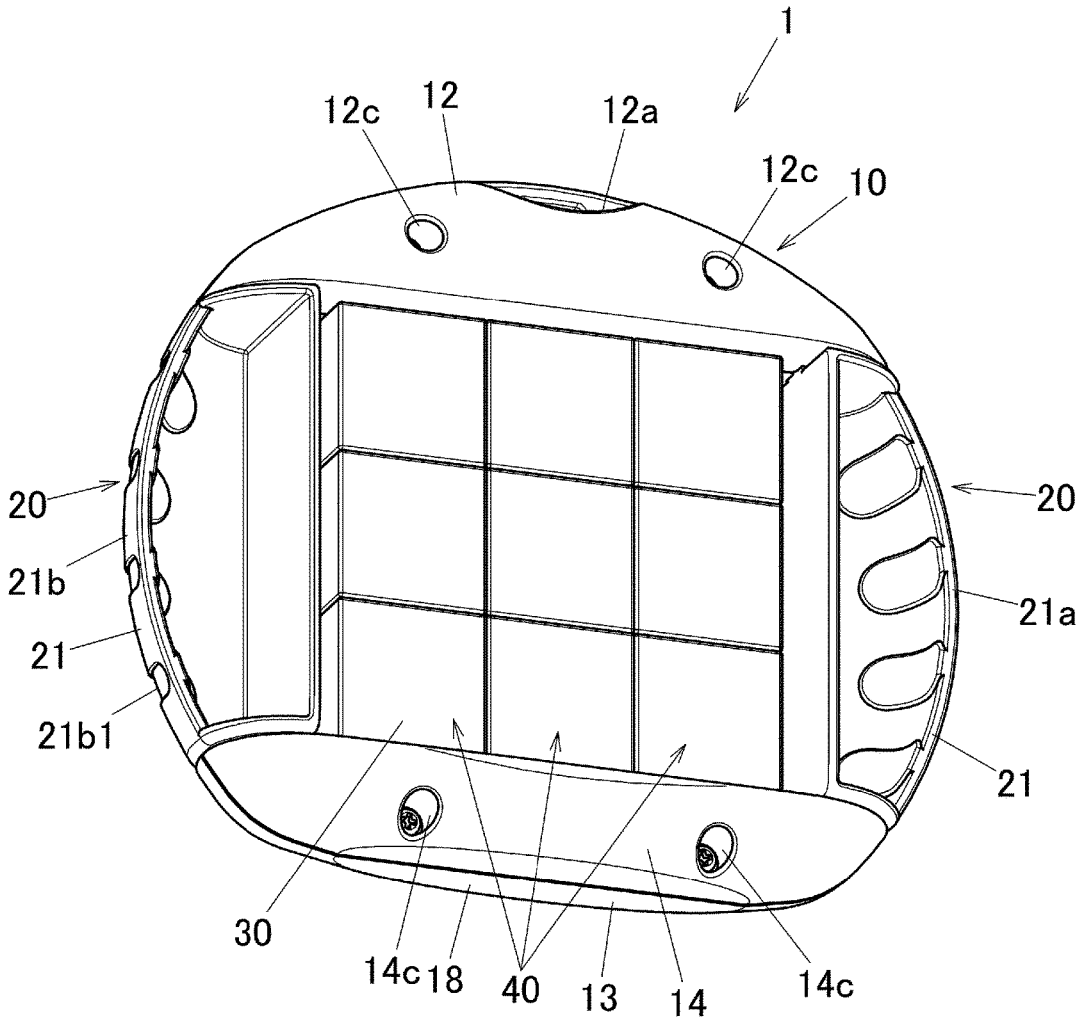
FIG. 2 is a perspective view of the puzzle according to the embodiment of the present invention, showing a back side of the puzzle.
Figure 3:
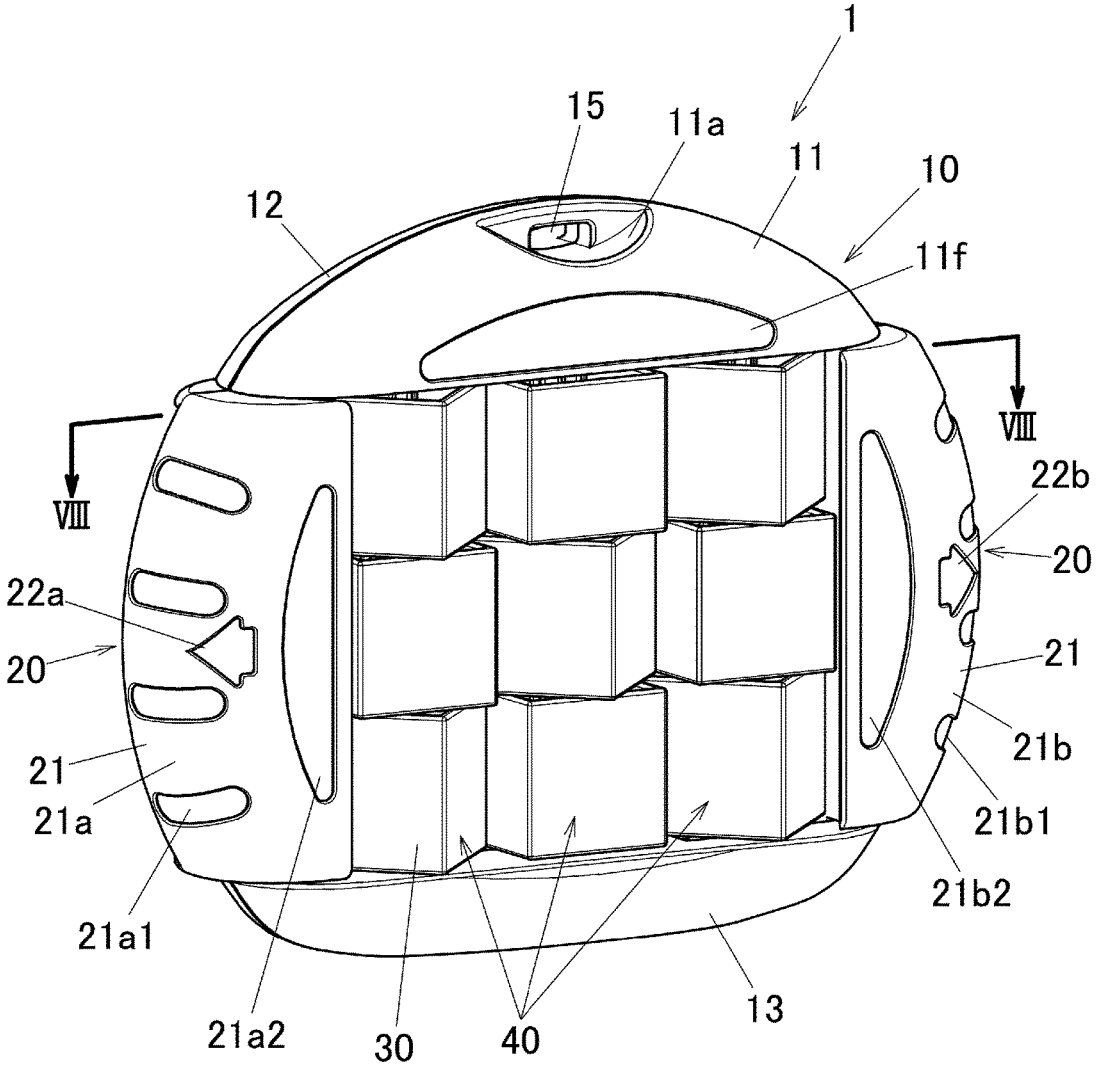
FIG. 3 is a perspective view of the puzzle according to the embodiment of the present invention, showing the front side of the puzzle in a state where some of a plurality of pieces are rotated with grip parts being slided.

Hereinafter, an embodiment of the present invention will be described along with the accompanying figures. A puzzle 1 has a housing main body 10, and a plurality of pieces 30 as shown in FIGS. 1, 2. With the puzzle 1, a player can play a matching puzzle game by rotating the pieces 30 as shown in FIG. 3 after gripping and pulling outward a left grip part 21*a* and a right grip part 21*b* by a left hand and a right hand respectively. The matching puzzle game includes, for example, matching all patterns on the pieces 30 to the same pattern, or producing an image using all the pieces 30. When the matching of the matching puzzle game is completed, the rotating of the pieces 30 can be restricted by pushing back the grip parts 21*a* and 21*b* to a state shown in FIG. 1. In descriptions hereinafter, a side where arrows 22*a*, 22*b* are disposed is referred to as front face (or front), an opposite side to the front face is referred to as back face (or back), a left side when facing the front face is referred to as left, an opposite side to the left is referred to as right, an upper side of the puzzle 1 in FIG. 1 is referred to as top, and an opposite side to the top is referred to as bottom.

In the housing main body 10, a top side edge and left and right edges are formed in a convex arc shape, a bottom side edge is formed substantially linearly, and connecting portions of the top side and the bottom side edges and the left and the right edges are formed in a rounded corner shape. The top side and the bottom side of the housing main body 10 are formed by joining front side components: the front face side top cover 11; the front face side bottom cover 13, and back side components: the back face side top cover 12; the back face side bottom cover 14, respectively. A hole portion 15 penetrating the front face side top cover 11 and the back face side top cover 12 is formed in a vicinity of the upper end portion of the convex arcuate edge portion of the front face side top cover 11 and the back face side top cover 12. On the front face side top cover 11 and the back face side top cover 12, arcuate concave portions 11*a*, 12*a*, which are downwardly convex, are respectively formed on a front face side and a back face side of the hole portion 15 to communicate each other. A laterally elongated recess 11*f*, which is long in the left and right and whose upper rim is curved in an arc shape, is formed on a front face side of the front face side top cover 11. A flat surface 18 is formed on the bottom end of the puzzle 1 where the front face side bottom cover 13 and the back face side bottom cover 14 are joined (refer to FIG. 2), whereby the puzzle 1 can be placed on a desk or the like in an upright position.

Figure 4:
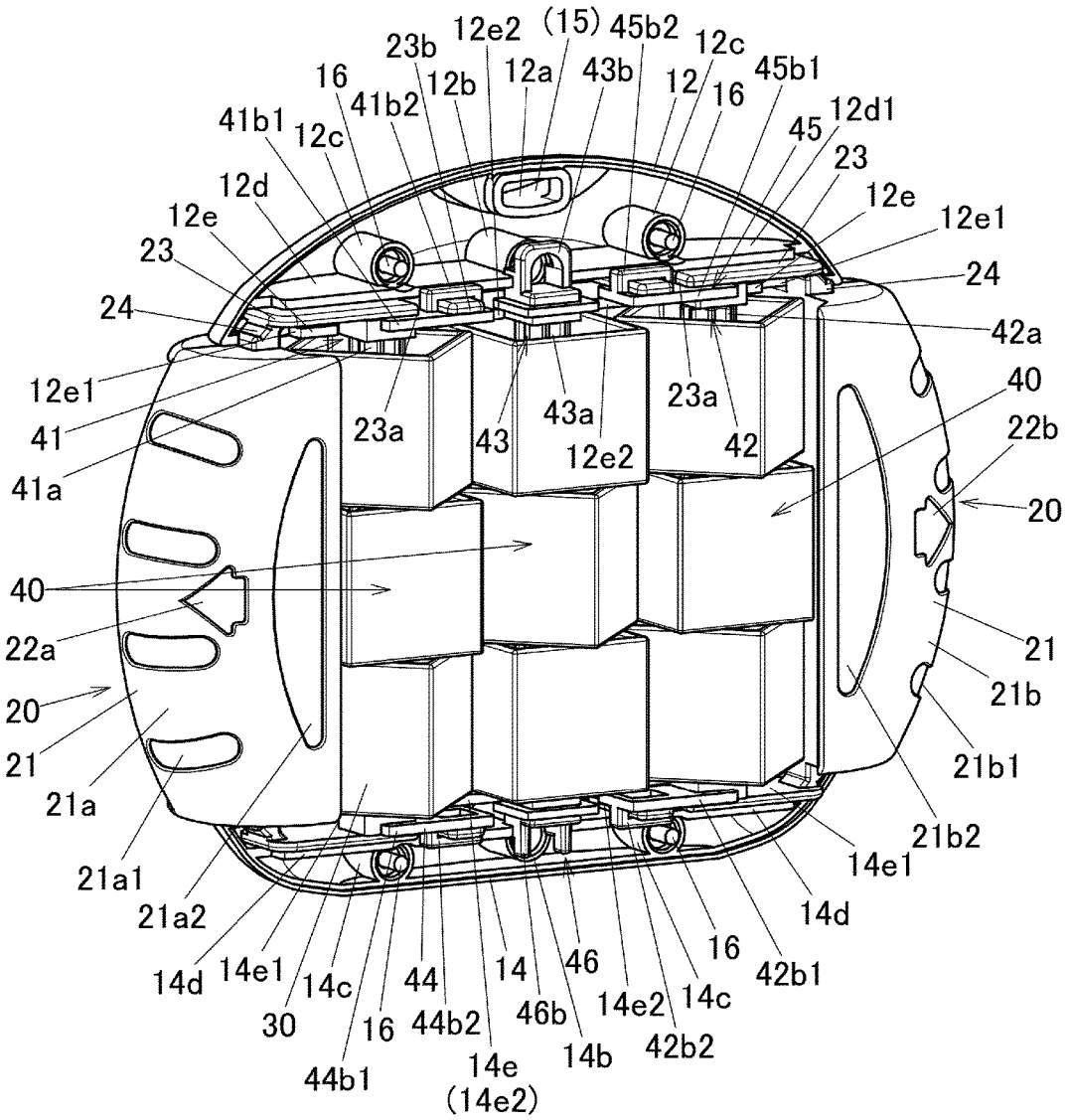
FIG. 4 is a perspective view of the puzzle according to the embodiment of the present invention, showing the front side of the puzzle with a front side top cover and a front side bottom cover removed in the state where some of the plurality of pieces are rotated with the grip part being slided.

The back face side top cover 12 is formed in a substantially shell-shape, as shown in FIG. 4. In an inside of the back face side top cover 12, a cylindrical bearing part 12*b* is provided at the center in left-right direction so that a shaft center is oriented to front-back direction. On the left and right sides of the bearing part 12*b*, deep recesses 12*c* are formed into which screws 16 are inserted from the back. In the inside of the back face side top cover 12, portions where the deep recesses 12*c* are formed are formed in a cylindrical shape and shaft centers of the portions are oriented to front-rear direction. Also in the inside of the back face side top cover 12, flat plate-shaped guide plates 12*d* are formed from the left and right edge portions toward the bearing part 12*b*. The guide plates 12*d* are provided so as to be overlapped with and joined to parts of the deep recesses 12*c* respectively.

Bottom plates 12*e* are formed beneath the guide plates 12*d* of the back face side top cover 12 having a predetermined distance from the guide plates 12*d*. A cutout 12*e*1 and a cutout 12*e*2 are formed on the bottom plates 12*e*. The cutout 12*e*1 guides and restricts a sliding movement in the left-right direction of a support base 24 of a slide plate 23 of left and right puzzle shaft moving members 20 (described later), and the cutout 12*e*2 guides and restricts the sliding movement in the left-right direction of a flat plate 41*b*1, 45*b*1 for supporting a left shaft 41*a* and a right shaft 42*a* of a puzzle shaft 40 (described later).

The front face side top cover 11 is formed also in the shell shape as with the back face side top cover 12. In an inside of the front face side top cover 11, a cylindrical insert shaft 11*b* is formed at the center in the left-right direction. The insert shaft lib is inserted into the bearing part 12*b* of the back face side top cover 12. Screw hole bosses 11*c* to which screws 16 are screwed are formed on positions corresponding to the deep recesses 12*c* of the back face side top cover 12. In the inside of the front face side top cover 11, guide plates 11*d*, bottom plates 11*e*, cutouts 11*e*1, 11*e*2 are formed, each corresponding to the guide plates 12*d*, bottom plates 12*e*, cutouts 12*e*1, 12*e*2 in the inside of the back face side top cover 12.

In addition, the back face side bottom cover 14 is formed in the shell shape, and in the inside of the back face side bottom cover 14, a bearing part 14*b*, deep recesses 14*c*, guide plates 14*d*, bottom plates 14*e*, cutouts 14*e*1, 14*e*2 are formed all in similar shapes to the bearing part 12*b*, deep recesses 12*c*, guide plates 12*d*, bottom plates 12*e*, cutouts 12*e*1, 12*e*2 of the back face side top cover 12. Furthermore, in the inside of the front face side bottom cover 13 formed in the shell shape, screw hole bosses 13*c*, guide plates 13*d*, bottom plates 13*e*, cutouts 13*e*1, 13*e*2 are formed all in similar shapes to the screw hole bosses 11*c*, guide plates 13*d*, bottom plates 11*e*, cutouts 11*e*1, 11*e*2 of the front face side top cover 11.

Puzzle shaft moving members 20 are disposed on the left and right sides of the housing main body 10. The puzzle shaft moving members 20 are puzzle shaft moving means for moving a left side puzzle shaft 40 of three puzzle shafts 40 (described later in detail) to the left, and a right side puzzle shaft 40 of the three puzzle shafts 40 to the right. Moving member main bodies 21 of the puzzle shaft moving members 20 are formed substantially in a shell shape and the back face sides of the moving member main bodies 21 are formed hollow. The moving member main bodies 21 are used as grip parts (a left grip part 21*a*, a right grip part 21*b*). Pluralities of long concave parts 21*a*1, long concave parts 21*b*1 for preventing slippage and arrow 22*a*, arrow 22*b* formed concave are provided to the grip parts (the left grip part 21*a*, the right grip part 21*b*), respectively. Finger-hooking recesses 21*a*2, 21*b*2 are provided to the front face side of the moving member main bodies 21, which are long in the top-bottom direction and whose outer rim is curved in an arc shape. When a user grips the grip parts (the left grip part 21*a*, the right grip part 21*b*), fingers other than thumbs are inserted into the back face sides of the moving member main bodies 21, which are formed hollow, and the thumbs can be hooked on the finger-hooking recesses 21*a*2, 21*b*2, thereby the puzzle shaft moving members 20 can be reliably gripped and moved.

Top and bottom ends of the puzzle shaft moving members 20 are formed flat. Support bases 24 are formed on the flat top and bottom ends. On end parts of the support bases 24, slide plates 23 are extended from the support bases 24 to inner directions. The slide plates 23 are formed in a flat plate shape and are slidably disposed in the left-right direction between the guide plates 11*d*, 12*d*, 13*d*, 14*d* and the bottom plates 11*e*, 12*e*, 13*e*, 14*e* of the front face side top cover 11, the back face side top cover 12, the front face side bottom cover 13, and the back face side bottom cover 14. Support bases 24 are guided by the cutouts 11*e*1, 12*e*1, 13*e*1, 14*e*1 of the bottom plates 11*e*, 12*e*, 13*e*, 14*e*, and left-right moving limits are defined by end parts of the cutouts 11*e*1, 12*e*1, 13*e*1, 14*e*1. Cutout portions 23*a* and engagement insertion portions 23*b* are formed on the slide plates 23.

Figure 6:
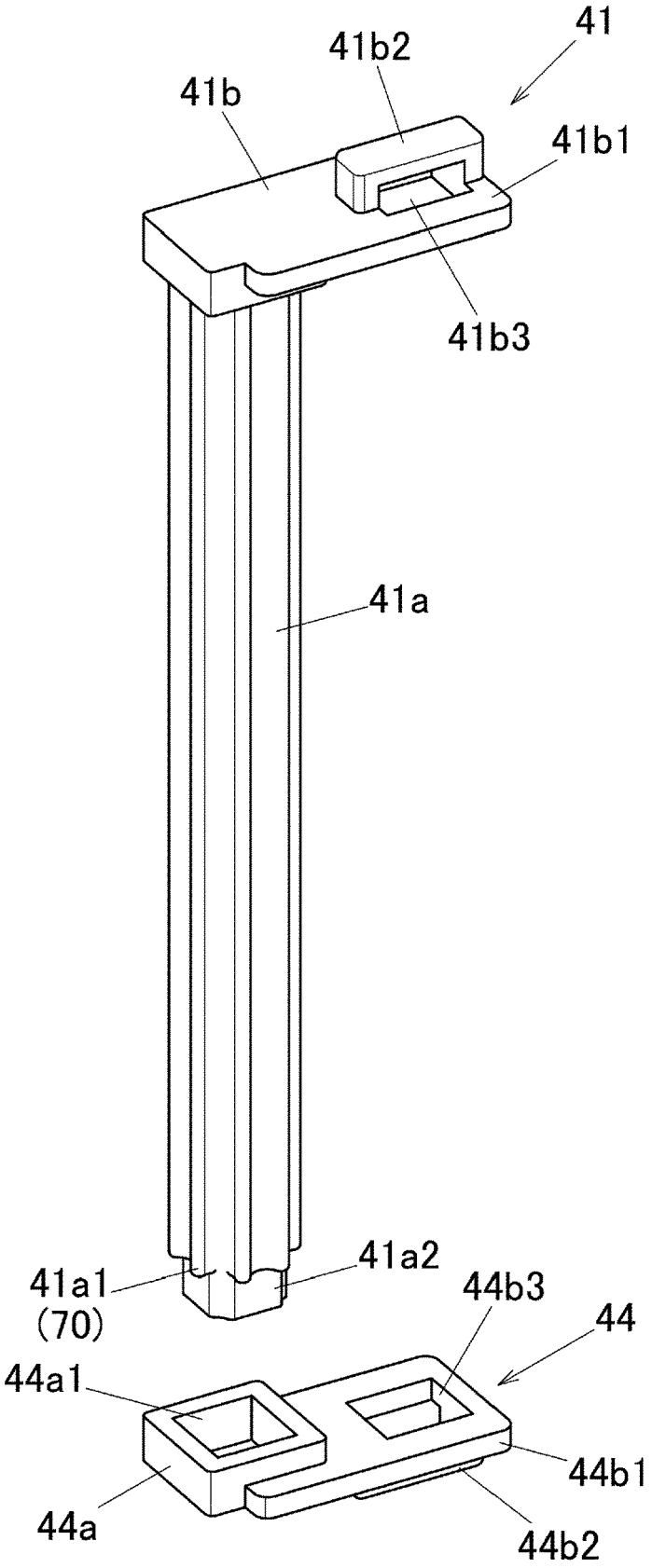
FIG. 6 is a perspective view of a shaft member and shaft support members on the left side of the puzzle according to the embodiment of the present invention.
Figure 8:
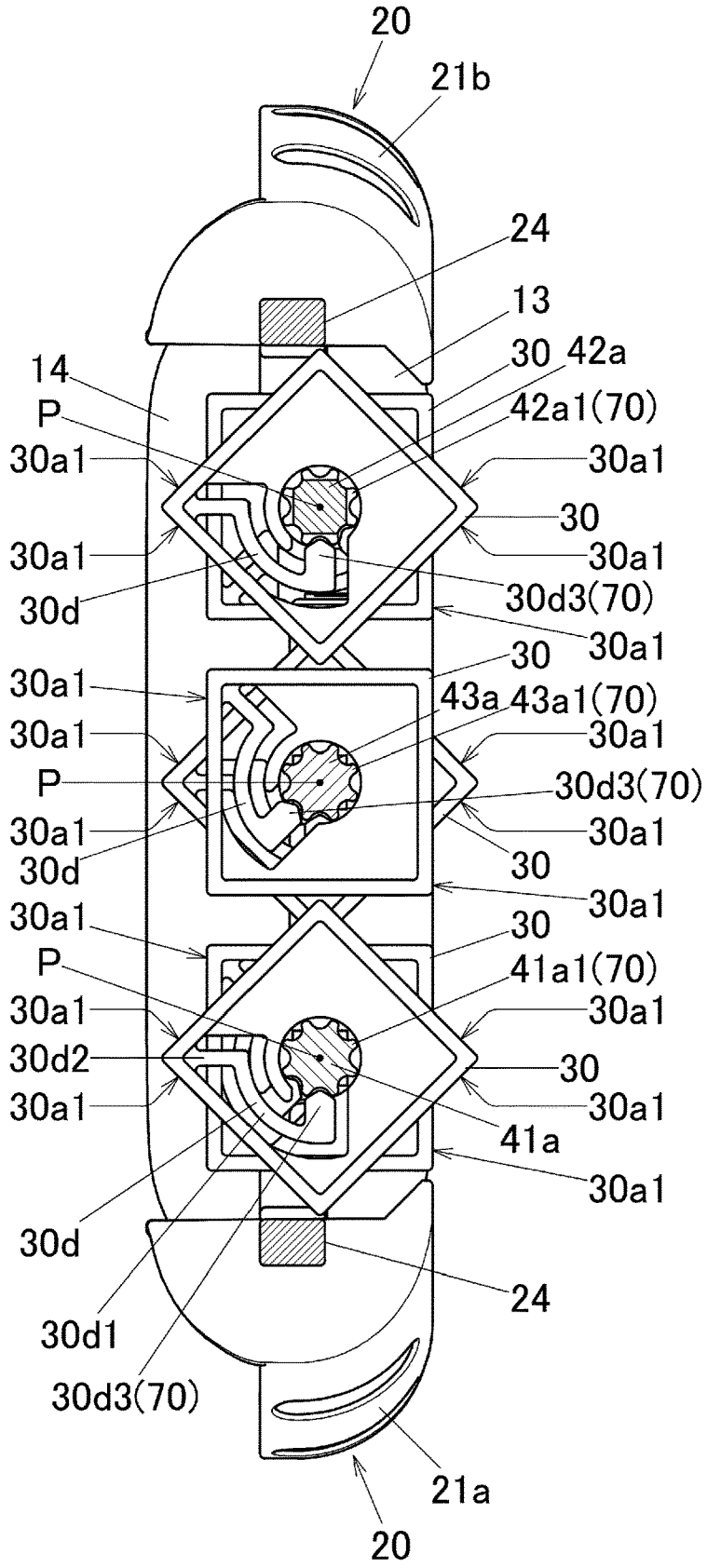
FIG. 8 is a cross sectional view of the puzzle according to the embodiment of the present invention taken along line VIII-VIII of FIG. 3.

The three puzzle shafts 40 are disposed to the housing main body 10. The puzzle shafts 40 are provided with shaft members 41, 42, 43 each having three pieces 30 and a shaft (left shaft 41*a*, right shaft 42*a*, center shaft 43*a*), and shaft support members 44, 45, 46. The shaft member 41 and the shaft support member 44 on the left side are shown in FIG. 6. The shaft member 41 is made up of a left shaft 41*a* that is long in the top-bottom direction and a shaft slide plate 41*b* that is fixed to a top end portion that is one end portion of the left shaft 41*a*. Ratchet teeth 41*a*1 are formed on an outer periphery of the left shaft 41*a*, as shown in FIG. 8. The ratchet teeth 41*a*1 include eight teeth. A substantially rectangular shaped fixing portion 41*a*2 is formed on a bottom end portion which is the other end portion of the left shaft 41*a*.

A flat plate portion 41*b*1 is formed on the shaft slide plate 41*b* in a substantially flat-plate shape that is slightly long in the left-right direction so that the left shaft 41*a* is fixed in the vicinity of a left end portion that is one side of the flat plate portion 41*b*1. An engaging hole portion 41*b*2 projecting in a downwardly opening U-shape is formed on a right end portion that is a top surface and the other side of the flat plate portion 41*b*1. A hole 41*b*3 is provided to the flat plate portion 41*b*1 of the shaft slide plate 41*b* corresponding to the engaging hole portion 41*b*2 by injection molding so as to form the engaging hole portion 41*b*2.

A shaft support member 44 is substantially in the same shape as the shaft slide plate 41*b*. That is to say, the shaft support member 44 includes a flat plate portion 44*b*1, an engaging hole portion 44*b*2, a hole 44*b*3, which have the same shape as the flat plate portion 41*b*1, the engaging hole portion 41*b*2, the hole 41*b*3 of the shaft slide plate 41*b*. A boss 44*a* is provided in the vicinity of a left end portion that is a top surface and one side of the flat plate portion 44*b*1 of the shaft support member 44. The boss 44*a* is provided with a fixing hole 44*a*1 into which a fixing portion 41*a*2 of the left shaft 41*a* is inserted.

Figure 5:
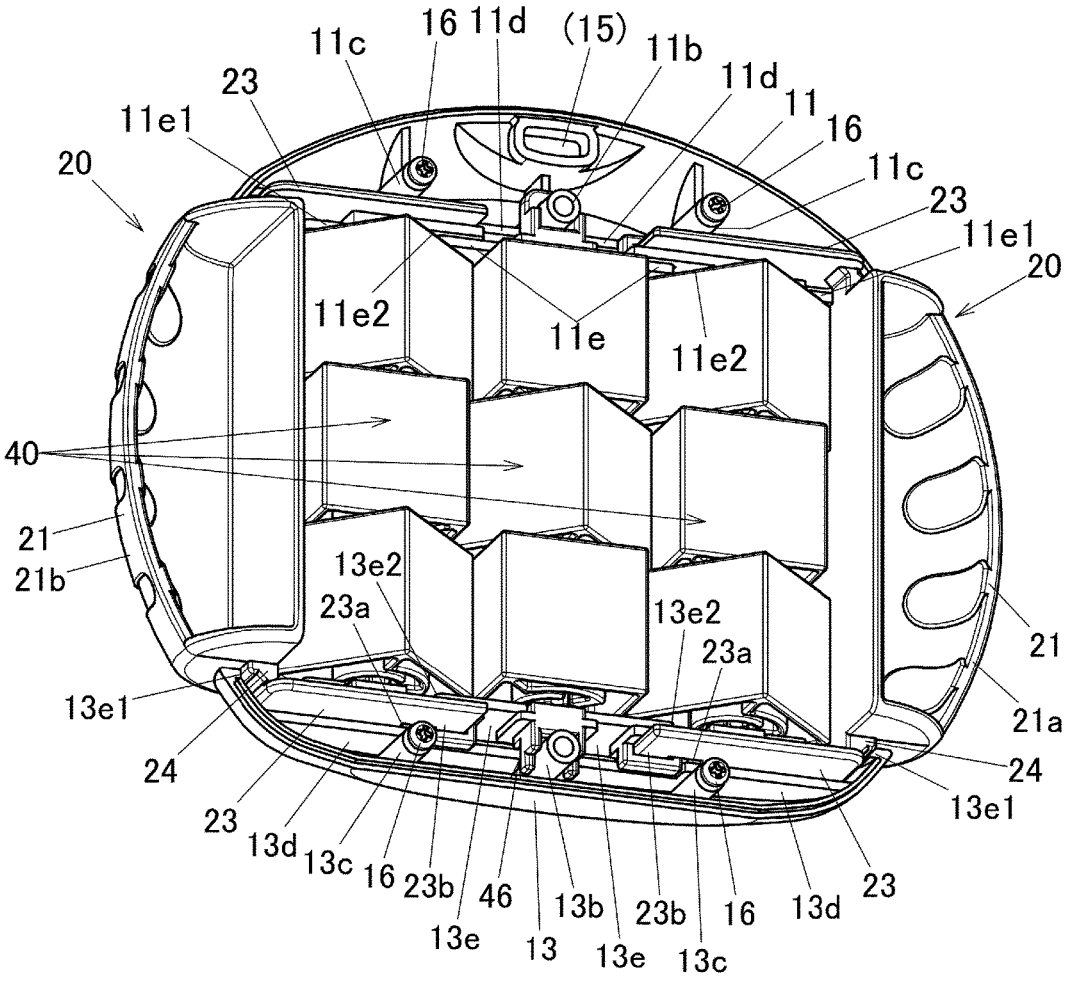
FIG. 5 is a perspective view of the puzzle according to the embodiment of the present invention, showing the back side of the puzzle with a back side top cover and a back side bottom cover removed in the state where some of the plurality of pieces are rotated with the grip part being slided.

As shown in FIGS. 4 and 5, a shaft member 41 and a shaft support member 44 on the left side are the same shape as the shaft member 42 and the shaft support member 45 on the right side. In addition, the shaft member 42 and the shaft support member 45 on the right side are provided upside down with respect to the shaft member 41 and the shaft support member 44 on the left. In FIG. 4, portions of the shaft member 42 and the shaft support member 45 on the right corresponding to the flat plate portions 41*b*1, 44*b*1 and the engaging hole portions 41*b*2 and 44*b*2 of the shaft member 41 and the shaft support member 44 on the left will be depicted with reference numerals as flat plate portions 42*b*1, 45*b*1 and engaging hole portions 42*b*2, 45*b*2. Engagement insertion portions 23*b* of the slide plate 23 of the puzzle shaft moving member 20 are inserted into and engaged with the each engagement hole portions 41*b*2, 44*b*2, 42*b*2, 45*b*2. The flat plate portions 41*b*1, 44*b*1, 42*b*1, 45*b*1 are slidably disposed in the left-right direction between the guide plates 11*d*, 12*d*, 13*d*, 14*d* and the bottom plates 11*e*, 12*e*, 13*e*, 14*e* of the front face side top cover 11, the back face side top cover 12, the front face side bottom cover 13, and the back face side bottom cover 14. The flat plate portions 41*b*1, 44*b*1, 42*b*1, 45*b*1 are guided by the cutouts 11*e*2, 12*e*2, 13*e*2, 14*e*2 of the bottom plates 11*e*, 12*e*, 13*e*, 14*e*, and left-right moving limits are defined by end parts of the cutouts 11*e*2, 12*e*2, 13*e*2, 14*e*2. In this way, the puzzle shaft moving members 20 are connected to the left and right outer two puzzle shafts 40. Lateral movement stroke of the support bases 24 of the puzzle shaft moving members 20 and lateral movement stroke of the flat plate portions 41*b*1, 44*b*1, 42*b*1, 45*b*1 are set to be the same. Amount of the stroke is set to a degree where the pieces 30 are rotatable when the puzzle shaft moving members 20 are moved to left and right limits. This will be described later in detail.

In addition, as shown in FIG. 4, the center shaft 43*a* of the shaft member 43 in the center is the same shape as the left shaft 41*a*, the right shaft 42*a*. A shaft fixing portion 43*b* is formed on the top end which is one end of the center shaft 43*a*. The shaft fixing portion 43*b* is formed in a downwardly opening U-shape and the insert shaft 11*b* of the front face side top cover 11 is inserted into the shaft fixing portion 43*b*. The shaft support member 46 is fitted to be fixed to a bottom side of the center shaft 43*a*. A U-shaped fixing portion 46*b* is formed on the bottom side which is the other side of the shaft support member 46. An insert shaft 13*b* of the front face side bottom cover 13 is inserted into a U-shaped portion of the fixing portion 46*b*. In this way, the shaft member 43 in the center and the center shaft 43*a* are fixed to the housing main body.

In this manner, three shafts (the left shaft 41*a*, the right shaft 42*a*, the center shaft 43*a*) are disposed in the housing main body 10 so as to be parallel to each other in the top-bottom direction so that the shaft centers of the three shafts are flush with each other. Consequently, the three shafts (the left shaft 41*a*, the right shaft 42*a*, the center shaft 43*a*) are disposed with rotation of the shaft centers fixed with respect to the housing main body 10. The shaft members 41, 42 (namely the left and right puzzle shafts 40) can be moved by the puzzle shaft moving members 20 in the left-right direction, which is a direction orthogonal to the shaft center direction of the shafts (left shaft 41*a*, right shaft 42*a*, central shaft 43*a*).

Figure 7A:
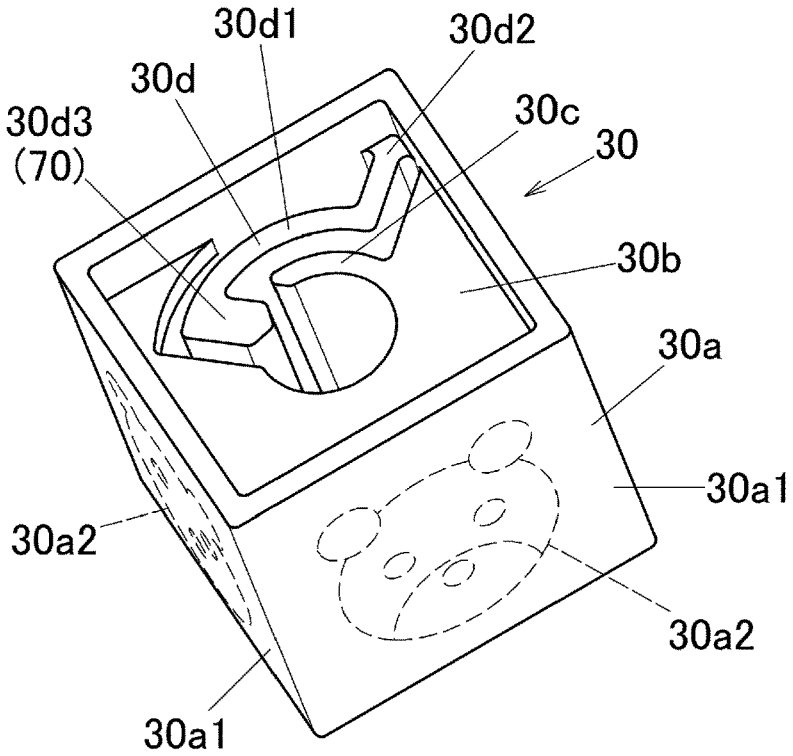
FIG. 7A is a perspective view of one of the plurality of the pieces of the puzzle according to the embodiment of the present invention seen from above.
Figure 7B:
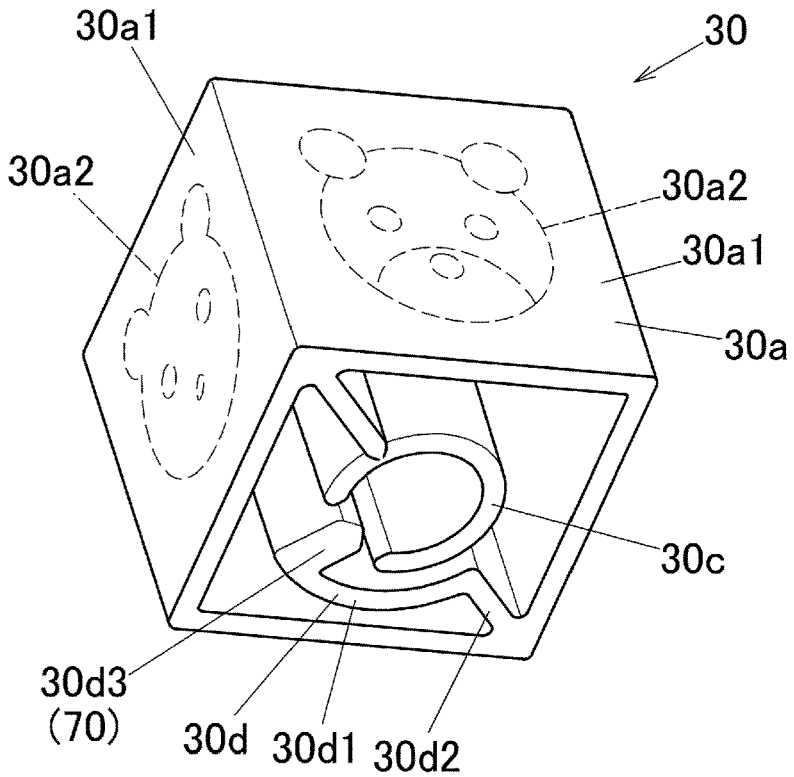
FIG. 7B is a perspective view of one of the plurality of the pieces of the puzzle according to the embodiment of the present invention seen from below.

The piece 30 is shown in FIGS. 7A and 7B. The piece 30 has a piece main body 30*a* that is a substantially square tubular shape. Thus, puzzle pattern surfaces 30*a*1 that are four flat surfaces are formed on an outer peripheral surface of the piece main body 30*a*. A plate portion 30*b* in a substantially plate shape connected to an inner peripheral surface of the piece main body 30*a* is formed so as to be orthogonal to the shaft center of the piece main body 30*a* in the vicinity of a top end which is one end of the piece main body 30*a*. A bearing portion 30*c* that is connected to the bottom surface of the plate portion 30*b* and is a substantially tubular shape extending in the bottom direction is formed around the shaft center of the piece main body 30*a*. A portion of the bearing portion 30*c* where facing a ratchet pawl 30*d*3 (described later) is cut out in a shaft direction of the bearing 30*c*. The bearing portion 30*c* is extended to a bottom end which is the other end of the piece main body 30*a*. A pawl support 30*d* is formed inside the piece main body 30*a* which is an outer periphery side of the bearing portion 30*c*. The pawl support 30*d* is made up of an elastic portion 30*d*1 formed in an arc shape, a connecting portion 30*d*2 that connects one end of the elastic portion 30*d*1 to an inner corner portion of the piece main body 30*a*, and a ratchet pawl 30*d*3 projecting toward the bearing portion 30*c* from the other end of the elastic portion 30*d*1. The pawl support 30*d* formed as described is extended to the bottom end of the piece main body 30*a*.

Puzzle patterns 30*a*2 such as animals or characters are provided to flat puzzle pattern surfaces 30*a*1 that are outer peripheral surfaces of the piece 30*a*, as shown by broken line in FIGS. 7A and 7B. The puzzle patterns 30*a*2 may be provided by printing as two-dimensional images, or by injection molding as a three-dimensional objects.

Three of the piece 30 formed in this way are arranged along a shaft center P of the each shaft (the left shaft 41*a*, right shaft 42*a*, center shaft 43*a*) of the shaft members 41, 42, 43 by inserting the each shaft (the left shaft 41*a*, right shaft 42*a*, center shaft 43*a*) into the bearing portion 30*c*. At this time, the piece 30 is rotatably provided around the shaft center P of the each shaft (the left shaft 41*a*, right shaft 42*a*, center shaft 43*a*) via a ratchet mechanism 70 composed of ratchet teeth 41*a*1, 42*a*1, 43*a*1 and ratchet pawl 30*d*3. In movement of the each shaft (the left shaft 41*a*, right shaft 42*a*, center shaft 43*a*) of the piece 30 in a shaft center P direction, a top end edge of the piece 30 on the top side abuts against bottom end edges of the front face side top cover 11 and the back face side top cover 12, whereby upward movement is restricted, and a bottom end edge of the piece 30 on the bottom side abuts against top end edges of the front face side bottom cover 13 and the back face side bottom cover 14, whereby movement downward movement is restricted.

The puzzle 1 formed in this way can be played as follows. In a state where the left and right puzzle shaft moving members 20 are closed as shown in FIG. 1, when moving the puzzle shaft moving members 20 to the left and right outward moving limits by gripping the left and right grip parts 21*a*, 21*b* and pulling the puzzle shaft moving members 20 in the left and right outer directions which are directions of the arrows 22*a*, 22*b*, the left puzzle shaft 40 moves to the left and the right puzzle shaft 40 moves to the right along with the puzzle shaft moving members 20.

When the puzzle shaft moving members 20 are moved to the left and right outward moving limits, as shown in FIG. 8, one piece 30 is made rotatable when the puzzle pattern surface 30*a*1 of the other piece 30 adjacent in the left-right direction faces front (or back). Specifically, among the three pieces 30 on the top shown in FIG. 8, in a state where the puzzle pattern surface 30*a*1 of the piece 30 in the center faces the front face side, the pieces 30 on both the left and right sides are made rotatable. In the three pieces 30 in the middle, in a state where the puzzle pattern surfaces 30*a*1 of the pieces 30 on the left and right sides face the front face side, the piece 30 in the center is made rotatable.

The pieces 30 can be positioned at every predetermined angle while being rotated since the pieces 30 and the shafts (the left shaft 41*a*, right shaft 42*a*, center shaft 43*a*) of the puzzle shafts 40 are ratchet engaged. In this embodiment, the pieces 30 can be positioned at every 45 degrees while being rotated. Therefore, even in young children, the positioning in the rotating direction of the pieces 30 can be done with ease, whereby puzzle games such as the matching puzzle game with the puzzle patterns 30*a*2 can be enjoyed with more enjoyment.

After the rotating operation of the pieces 30 is completed with all the puzzle pattern surfaces 30*a*1 of the pieces 30 being positioned facing front face direction, the grip parts 21*a*, 21*b* are gripped and the puzzle shaft moving members 20 are moved inward directions opposite to the arrows 22*a*, 22*b*, whereby the puzzle 1 is back to the state in FIG. 1, and the pieces 30 are made non-rotatable.

Note that the present invention is not limited to the embodiment that has been described heretofore and hence can be freely modified or improved without departing from the spirit and scope of the present invention. For example, the each piece 30 in this embodiment includes four flat puzzle pattern surfaces 30*a*1. However, the puzzle pattern surface 30*a*1 may be spherical surface and five or more. In addition, although the three puzzle shafts 40 are provided in this embodiment, the present invention can be implemented with one or more puzzle shafts 40.

What is claimed is:

1. A puzzle comprising:

a housing main body;

three puzzle shafts secured relative to the housing main body, wherein each of the three puzzle shafts is fixed so as not to rotate around a shaft center thereof, a plurality of pieces rotatably mounted on each of the three puzzle shafts so as to rotate around the shaft center, wherein puzzle patterns are provided on an outer periphery of each of the plurality of pieces, wherein each of the plurality of pieces includes a ratchet pawl; and a ratchet mechanism configured with ratchet teeth formed on an outer periphery of each of the three puzzle shafts, wherein the ratchet pawl on each of the plurality of pieces is elastically configured to engage the ratchet teeth, wherein the housing main body has two moving member main bodies disposed alongside the shafts used as right and left grip parts which are connected respectively to each of two outer puzzle shafts of the three puzzle shafts so as to move the two outer puzzle shafts in an outer direction orthogonal to a longitudinal extent of the three puzzle shafts, wherein each of the two moving member main bodies is formed substantially with a shell shape, has a back face side that is hollow, and a front face side with finger-hooking recesses.

* * * * *